US007488912B2

(12) United States Patent
Yang et al.

(10) Patent No.: US 7,488,912 B2
(45) Date of Patent: Feb. 10, 2009

(54) SENSING MECHANISM AND ELECTRONIC APPARATUS HAVING THE SAME

(75) Inventors: Zhen-Feng Yang, Shanghai (CN); Nathan Nai-Hsien Wang, Taipei (TW)

(73) Assignee: Inventec Corporation (TW)

( * ) Notice: Subject to any disclaimer, the term of this patent is extended or adjusted under 35 U.S.C. 154(b) by 51 days.

(21) Appl. No.: 11/818,265

(22) Filed: Jun. 13, 2007

(65) Prior Publication Data

US 2008/0169177 A1 Jul. 17, 2008

(51) Int. Cl.
*H01H 3/20* (2006.01)

(52) U.S. Cl. ..... 200/331; 200/400

(58) Field of Classification Search ..... 200/6 A, 200/17 R, 400, 401, 500, 501, 43.11–43.15
See application file for complete search history.

(56) References Cited

U.S. PATENT DOCUMENTS 4,689,455 A * 8/1987 Watanabe ..... 200/534
6,803,532 B1 * 10/2004 Lee ..... 200/6 A
7,256,363 B1 * 8/2007 McConnell et al. ..... 200/343
7,315,006 B2 * 1/2008 Houck et al. ..... 200/331
7,368,675 B2 * 5/2008 Ishido et al. ..... 200/331

* cited by examiner

*Primary Examiner*—Michael A Friedhofer
*Assistant Examiner*—Lisa N Klaus
(74) *Attorney, Agent, or Firm*—Peter F. Corless; Steven M. Jensen; Edwards Angell Palmer & Dodge LLP

(57) ABSTRACT

An electronic apparatus has a sensing mechanism and is disposed to a circuit board having a sensing switch, including a receptacle housing having an opening disposed at one side thereof, the opening having a top portion and a bottom portion, the top portion having a stopping end portion; an action member disposed in the opening and having a stopping flange abutting against the stopping end portion; an elastic member disposed between the stopping flange and the top of the bottom portion of the opening so as to make the top of the action member protrude to a region outside of the top of the receptacle housing; and a lid body for covering the receptacle housing and meanwhile pressing the action member so as to make the action member start the sensing switch, thereby confirming that the receptacle housing is covered by the lid body.

18 Claims, 2 Drawing Sheets

SENSING MECHANISM AND ELECTRONIC APPARATUS HAVING THE SAME

BACKGROUND OF THE INVENTION

1. Field of the Invention

The present invention relates generally to a sensing mechanism, and more particularly, to a sensing mechanism for sensing the secure status of a battery of an electronic apparatus.

2. Description of Related Art

Battery modules are applied in electronic apparatus such as desktop computers, notebook computers and servers for retaining data when power is off.

Generally, a receptacle housing is provided to receive a battery module, and a lid body is provided to cover the receptacle housing such that the battery module can be secured in the receptacle housing. However, during a design verification process of a server, testing engineers may forget to cover the receptacle housing of the battery module with the lid body. As a result, when the server computer is started, the battery module may come off the receptacle housing, which causes sudden shut off of the server and thus results in a data loss.

More particularly, as no sensing mechanism is provided between the receptacle housing and the lid body of the battery module, users cannot be timely informed in the case the lid body does not cover the receptacle housing, thus easily leading to an unexpected falling of the battery module off the receptacle housing.

A same problem also exists in battery modules that are disposed in other electronic apparatus for providing power.

Therefore, there exists a strong need to overcome the above drawback.

SUMMARY OF THE INVENTION

According to the above drawback, an objective of the present invention is to provide a sensing mechanism and an electronic apparatus having the sensing mechanism, which can detect whether the lid body covers the receptacle housing of a battery module so as to adjust the power management.

In order to attain the above and other objectives, the present invention provides a sensing mechanism disposed in a receptacle housing for sensing whether the receptacle housing is covered by a lid body or not, wherein the receptacle housing is connected to a circuit board having a sensing switch. The sensing mechanism is characterized in that: the receptacle housing comprises an opening, which is disposed at one side thereof, corresponding in position to the sensing switch, the opening comprising a top portion and a bottom portion, the top portion being connected with the top of the receptacle housing, bottom portion being connected with the bottom of the receptacle housing, the top portion having a stopping end portion and an inner diameter larger than that of the bottom portion; an action member is disposed in the opening and has a length longer than a depth of the opening and an outer diameter matching an inner diameter of the bottom portion of the opening, the action member having a stopping flange abutting against the stopping end portion; and an elastic member is disposed between the stopping flange of the action member and the top of the bottom portion of the opening so as to make the top of the action member protrude to a region outside of the top of the receptacle housing, wherein when the lid body covers the receptacle housing, the action member is pressed by the lid body so as to move downward, thereby starting the sensing switch.

To attain the above and other objectives, the present invention also provides an electronic apparatus having a sensing mechanism, wherein the electronic apparatus is disposed to a circuit board having a sensing switch. The electronic apparatus comprises: a receptacle housing having an opening disposed at one side thereof corresponding in position to the sensing switch, the opening comprising a top portion and a bottom portion, the top portion being connected with the top of the receptacle housing, the bottom portion being connected with the bottom of the receptacle housing, the top portion having a stopping end portion and an inner diameter larger than that of the bottom portion; an action member having a length longer than a depth of the opening and an outer diameter matching an inner diameter of the bottom portion of the opening, the action member having a stopping flange abutting against the stopping end portion for restricting the degree of freedom of motion of the action member in an upward direction; an elastic member disposed between the stopping flange of the action member and the top of the bottom portion of the opening so as to make the top of the action member protrude to a region outside of the top of the receptacle housing; and a lid body for covering the receptacle housing and meanwhile pressing the action member so as to make the action member start the sensing switch, thereby confirming that the receptacle housing is covered by the lid body.

A battery module is disposed in the receptacle housing. If the receptacle housing is not covered by the lid body, the top of the action member that is supported by the elastic member protrudes over the top of the receptacle housing. In this case, the sensing switch sends a signal indicating the receptacle housing is not covered by the lid body to the circuit board. According to the signal information, the power management can be adjusted, thus preventing occurrence of falling of the battery module from the receptacle housing and accordingly preventing the data loss.

Therefore, the sensing mechanism and the electronic apparatus having the sensing mechanism of the present invention can easily detect whether the lid body correctly covers the receptacle housing through the starting status of the sensing switch that can be started by the action member. Therefore, the power management can further be adjusted according to the detected information so as to overcome the conventional drawback.

DETAILED DESCRIPTION OF PREFERRED EMBODIMENTS

The following illustrative embodiments are provided to illustrate the disclosure of the present invention, these and other advantages and effects can be apparent to those skilled in the art after reading the disclosure of this specification. The present invention can also be performed or applied by other different embodiments. The details of the specification may be on the basis of different points and applications, and numerous modifications and variations can be made without departing from the spirit of the present invention.

Figure 1:
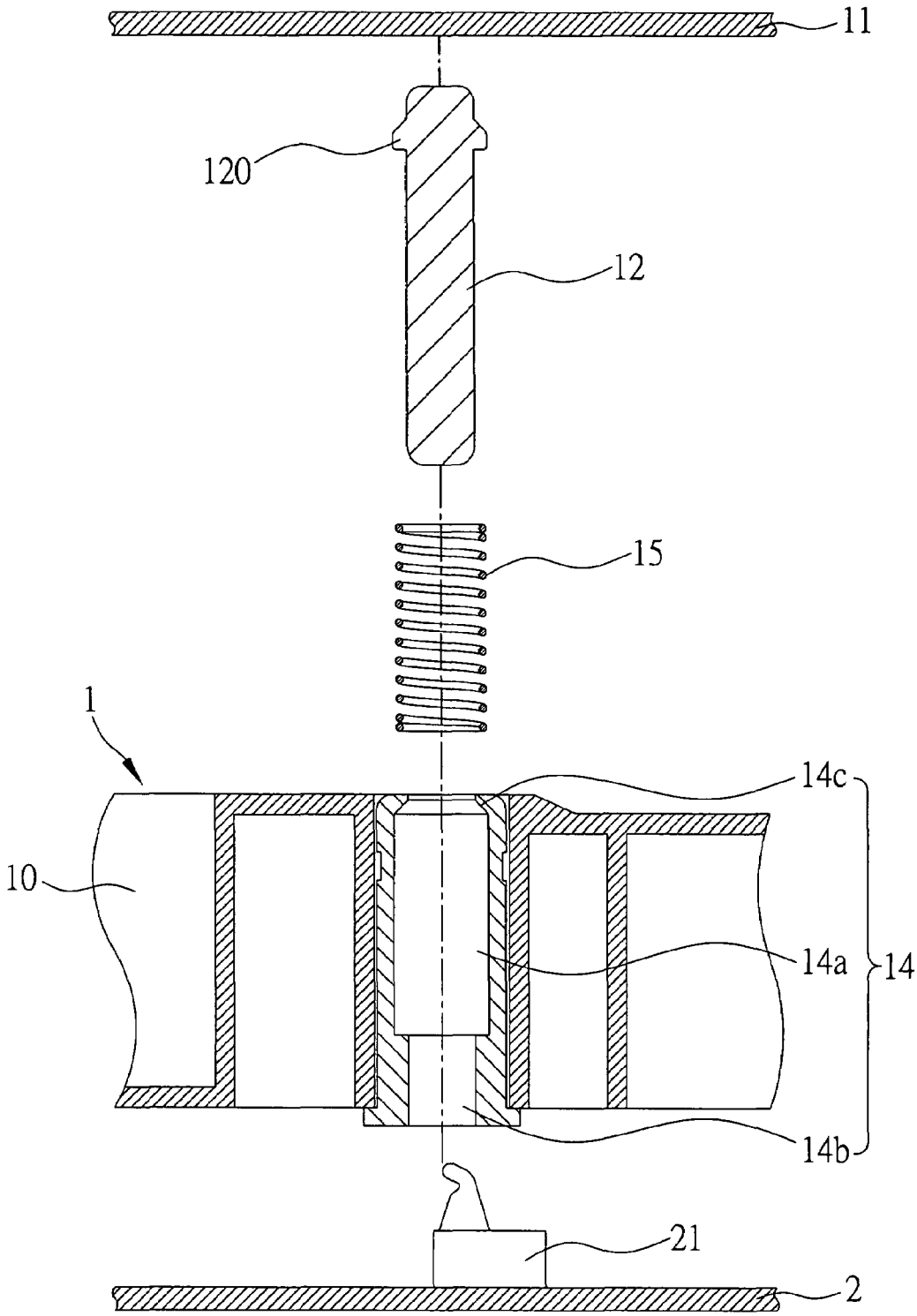
FIG. 1 is an exploded diagram of a sensing mechanism and an electronic apparatus having the sensing mechanism according to a preferred embodiment of the present invention.

Referring to FIG. 1, an electronic apparatus 1 that is disposed on a circuit board 2 comprises: a receptacle housing 10 having an opening 14 disposed at one side thereof; a lid body 11; an action member 12; and an elastic member 15. The receptacle housing 10 is connected to the circuit board 2. A battery module (not shown) is received in the receptacle housing 10, and the electronic apparatus is therefore a battery apparatus. The circuit board 2 may be a motherboard of a server, a personal computer, a notebook computer or the like. The circuit board 2 has a sensing switch 21, which could be a switch with a resilient force or not. In the preferred embodiment, the sensing switch 21 has a resilient force. The sensing switch 21 transfers messages about whether the electronic apparatus 1 is powered on or off to the circuit board 2, to adjust power management of the electronic apparatus 1.

The opening 14 is disposed at a position corresponding to the sensing switch 21. The opening 14 comprises a top portion 14*a* connected with the top of the receptacle housing 10, and a bottom portion 14*b* connected with the bottom of the receptacle housing 10 and having an inner diameter smaller than that of the top portion 14*a*. A stopping end portion 14*c* is further formed at the top of the top portion 14*a* by bending the receptacle housing 10 around the top of the opening 14 inward. The stopping end portion 14*c* may be a protruding ring or a plurality of protruding blocks disposed surrounding the inner edges of the opening 14. In addition, the stopping end portion 14 is not limited to be disposed on the top of the top portion 14*a*. Instead, the stopping end portion 14 can be disposed at any position of the top portion 14*a*.

The length of the action member 12 is slightly longer than the depth of the opening 14, and the outer diameter of the action member 12 matches the inner diameter of the bottom portion 14*b*. Preferably, the outer diameter of the action member 12 also matches the inner diameter of the stopping end portion 14*c* at the top of the top potion 14*a* so as to enhance the positioning effect of the action member 12 in the opening 14. A stopping flange 120 is disposed close to the top of the action member 12 for abutting against the stopping end portion 14*c* so as to restrict the degree of freedom of motion of the action member 12 in an upward direction. Of course, the position of the stopping flange 120 can be changed according to the position of the stopping end portion 14*c*. The action member 12 may be a shaft body or a tube body. The stopping flange 120 is disposed surrounding the action member 12. Alternatively, a plurality of stopping flanges 120 spaced apart from each other is disposed surrounding the action member 12, or two stopping flanges 120 are disposed at opposite sides of the action member 12.

The elastic member 15 may be a coil spring or any other element having a resilient force. The elastic member 15 is disposed between the stopping flange 120 of the action member 12 and the top of the bottom portion 14*b* of the opening 14 such that the top of the action member 12 can protrude through the opening 14 to a region outside of the top of the receptacle housing 10. The natural length of the elastic member 15 is at least slightly longer than a distance from the stopping end portion 14*c* to the bottom of the top portion of the opening 14 when the stopping flange 120 abuts against the stopping end portion 14*c*. As the stopping flange 120 and the stopping end portion 14*c* are disposed at top of the action member 12 and the opening 14, respectively, the natural length of the elastic member 15 can correspond to the length of the top portion of the opening 14 such that the top of the action member 12 can protrude over the receptacle housing when no force is applied and the action member 12 is close to the sensing switch when the elastic member 15 is not pressed.

Figure 2:
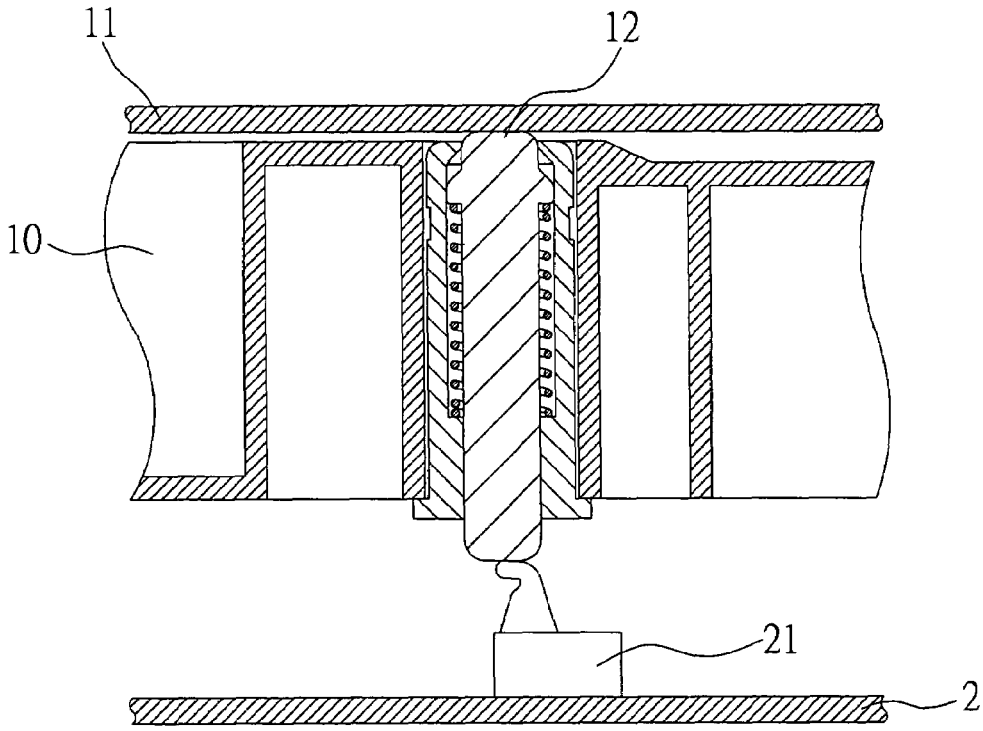
FIG. 2 is an operational diagram of a sensing mechanism according to the present invention.
Figure 3:
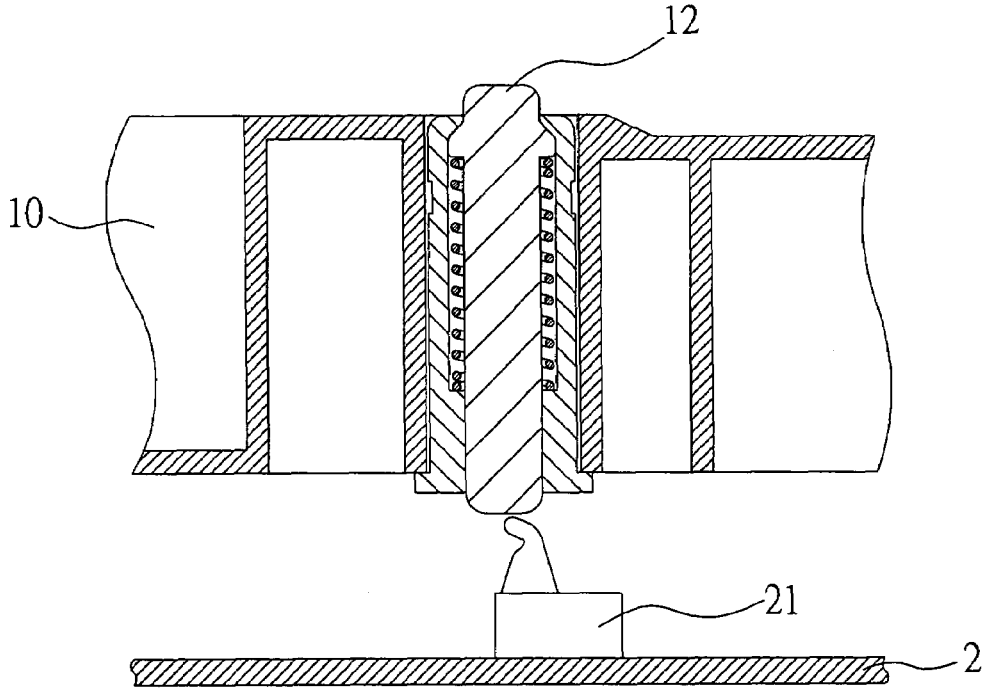
FIG. 3 is an operational diagram of an electronic apparatus having the sensing mechanism shown in FIG. 2.

Referring to FIGS. 2 and 3, in the case that the lid body 11 covers the receptacle housing 10, the action member 12 is pressed by the lid body 11 to move downward. As a result, the bottom of the action member 12 triggers the sensing switch 21. When the sensing switch 21 is started, messages indicating that the receptacle housing 10 is well covered by the lid body 11 are transferred to the circuit board 2. On the other hand, in the case that the receptacle housing 10 is not covered by the lid body 11, the sensing switch 21 continuously sends another messages indicating that the receptacle housing 10 is not covered by the lid body 11 to the circuit board 2. According to the messages, the power management can be adjusted, thus preventing occurrence of sudden power-off of the electronic apparatus due to the falling of the battery module off the receptacle housing 10.

The sensing switch 21 can be a switch having a resilient force, and in this case, the length of the action member 12 is slightly longer than s vertical distance from the top of the receptacle housing 10 to the top of the sensing switch 21. The sensing switch 21 can also be a switch that is started by triggering, and in this case, the length of the action member 12 is equal to the vertical distance from the top of the receptacle housing 10 to the top of the sensing switch 21.

Therefore, the sensing mechanism and the electronic apparatus 1 having the sensing mechanism of the present invention provide a way of detecting whether the lid body 11 is correctly disposed on the receptacle housing 10 through the starting status of the sensing switch 21 that can be started by the action member 12 such that the power management can further be adjusted according to the detected information, thereby overcoming the conventional drawback.

The above-described descriptions of the detailed embodiments are only to illustrate the preferred implementation according to the present invention, and it is not to limit the scope of the present invention. Accordingly, all modifications and variations completed by those with ordinary skill in the art should fall within the scope of present invention defined by the appended claims.

What is claimed is:

1. A sensing mechanism disposed in a receptacle housing for sensing whether the receptacle housing is covered by a lid body or not, the receptacle housing being connected to a circuit board having a sensing switch, the sensing mechanism being characterized in that:

the receptacle housing comprises an opening disposed at one side thereof, corresponding in position to the sensing switch, the opening comprising a top portion and a bottom portion, the top portion being connected with the top of the receptacle housing, the bottom portion being connected with the bottom of the receptacle housing, the top portion having a stopping end portion and an inner diameter larger than that of the bottom portion;

an action member is disposed in the opening and has a length longer than a depth of the opening and an outer diameter matching an inner diameter of the bottom portion of the opening, the action member having a stopping flange abutting against the stopping end portion; and an elastic member is disposed between the stopping flange of the action member and the top of the bottom portion of the opening so as to make the top of the action member protrude to a region outside of the top of the receptacle housing, wherein when the lid body covers the receptacle housing, the action member is pressed by the lid body so as to move downward, thereby starting the sensing switch.

2. The sensing mechanism of claim 1, wherein the action member is one of a shaft body and a tube body.

3. The sensing mechanism of claim 1, wherein the stopping end portion is formed by bending the receptacle housing around the top of the opening inward, and the stopping flange is disposed close to the top of the action member.

4. The sensing mechanism of claim 3, wherein the stopping flange is disposed surrounding the action member.

5. The sensing mechanism of claim 3, wherein a plurality of stopping flanges spaced apart from each other is disposed surrounding the action member.

6. The sensing mechanism of claim 3, wherein two stopping flanges are respectively disposed at two opposite sides of the action member.

7. The sensing mechanism of claim 1, wherein the elastic member is a coil spring.

8. The sensing mechanism of claim 1, wherein the elastic member has a natural length longer than a distance from the stopping end portion to the bottom of the top portion of the opening when the stopping flange abuts against the stopping end portion.

9. The sensing mechanism of claim 1, wherein the action member has a length longer than a vertical distance from the top of the receptacle housing to the top of the sensing switch, and the sensing switch is a switch having a resilient force.

10. The sensing mechanism of claim 1, wherein the action member has a length equal to a vertical distance from the top of the receptacle housing to the top of the sensing switch, and the sensing switch is a switch that is started by triggering.

11. An electronic apparatus having a sensing mechanism, the electronic apparatus being disposed to a circuit board having a sensing switch, the electronic apparatus comprising:

a receptacle housing having an opening disposed at one side thereof corresponding in position to the sensing switch, the opening comprising a top portion and a bottom portion, the top portion being connected with the top of the receptacle housing, the bottom portion being connected with the bottom of the receptacle housing, the top portion having a stopping end portion and an inner diameter larger than that of the bottom portion;

an action member having a length longer than a depth of the opening and an outer diameter matching an inner diameter of the bottom portion of the opening, the action member having a stopping flange abutting against the stopping end portion for restricting the degree of freedom of motion of the action member in an upward direction;

an elastic member disposed between the stopping flange of the action member and the top of the bottom portion of the opening so as to make the top of the action member protrude to a region outside of the top of the receptacle housing; and a lid body for covering the receptacle housing and meanwhile pressing the action member so as to make the action member start the sensing switch, thereby confirming that the receptacle housing is covered by the lid body.

12. The electronic apparatus of claim 11, wherein the stopping end portion is formed by bending the receptacle housing around the top of the opening inward, and the stopping flange is disposed close to the top of the action member.

13. The electronic apparatus of claim 12, wherein the stopping flange is disposed surrounding the action member.

14. The electronic apparatus of claim 12, wherein a plurality of stopping flanges spaced apart from each other is disposed surrounding the action member.

15. The electronic apparatus of claim 12, wherein two stopping flanges are respectively disposed at two opposite sides of the action member.

16. The electronic apparatus of claim 11, wherein the elastic member has a natural length longer than a distance from the stopping end portion to the bottom of the top portion of the opening when the stopping flange abuts against the stopping end portion.

17. The electronic apparatus of claim 11, wherein the action member has a length longer than a vertical distance from the top of the receptacle housing to the top of the sensing switch, and the sensing switch is a switch having a resilient force.

18. The sensing mechanism of claim 11, wherein the action member has a length equal to a vertical distance from the top of the receptacle housing to the top of the sensing switch, and the sensing switch is a switch that is started by triggering.

* * * * *